US006289771B1

(12) United States Patent
Hsieh

(10) Patent No.: US 6,289,771 B1
(45) Date of Patent: Sep. 18, 2001

(54) DOUBLE-REVERSIBLE RATCHET WRENCH

(76) Inventor: Chih-Ching Hsieh, No. 64, Lane 107, Liang Tsun Rd., Fong Yuan City, Taichung Hsien (TW)

( * ) Notice: Subject to any disclaimer, the term of this patent is extended or adjusted under 35 U.S.C. 154(b) by 0 days.

(21) Appl. No.: 09/610,963

(22) Filed: Jul. 6, 2000

(51) Int. Cl.[7] ..... B25B 13/46

(52) U.S. Cl. ..... 81/63; 81/63.2

(58) Field of Search ..... 81/61–63.2

*Primary Examiner*—D. S. Meislin
(74) *Attorney, Agent, or Firm*—Varndell & Varndell, PLLC

(57) ABSTRACT

A double-reversible ratchet wrench includes a wrench body defining a box, a ratchet wheel mounted in the box of the wrench body and adapted for turning a bolt or nut with the wrench body, a stop member mounted in the box end of the wrench body and shifted between two positions to control the direction of rotation of the ratchet wheel relative to the wrench body, the stop member having a smoothly arched, outwardly curved, toothed engagement face forced into engagement with the ratchet wheel to limit the direction of rotation of the ratchet wheel in the wrench body, a backward finger strip extended out of the box of the wrench body and adapted for operation by hand to turn the stop member in the box and to shift the engagement between one of two halves of the engagement face of the stop member with the ratchet wheel in controlling the steering direction of the ratchet wheel.

1 Claim, 15 Drawing Sheets

DOUBLE-REVERSIBLE RATCHET WRENCH

BACKGROUND AND SUMMARY OF THE INVENTION

The present invention relates to a reversible ratchet wrench, and more particularly to a high-torsion type double-reversible ratchet wrench.

A variety of combination wrenches, hexagon wrenches, ratchet wrenches, reversible ratchet wrenches, etc., have been disclosed for use to turn screw bolts and nuts, and have appeared on the market. However, conventional reversible ratchet wrenches have various drawbacks including (1) low torsional force; (2) complicated structure, high manufacturing cost, being slippy; and (3) not able to be closely attached to the workpiece. Figures from 1 through 7 show various structures of commercially available reversible ratchet wrenches. The designs shown in FIGS. 1 and 2 have the aforesaid three common drawbacks. The designs shown in Figures from 3 through 7 have the aforesaid first and second drawbacks. More particularly, the ratchet wheel according to the designs shown in FIGS. 4 and 7 tends to slip.

It is one object of the present invention to provide a double-reversible ratchet wrench, which bears high torsionl force. It is another object of the present invention to provide a double-reversible ratchet wrench, which has a simple structure. It is still another object of the present invention to provide a double-reversible ratchet wrench, which can be closely and positively attached to the workpiece in either of two reversed directions, enabling the workpiece to be positively rotated with the ratchet wheel and the wrench body.

DETAILED DESCRIPTION OF THE PREFERRED EMBODIMENT

Figure 1:
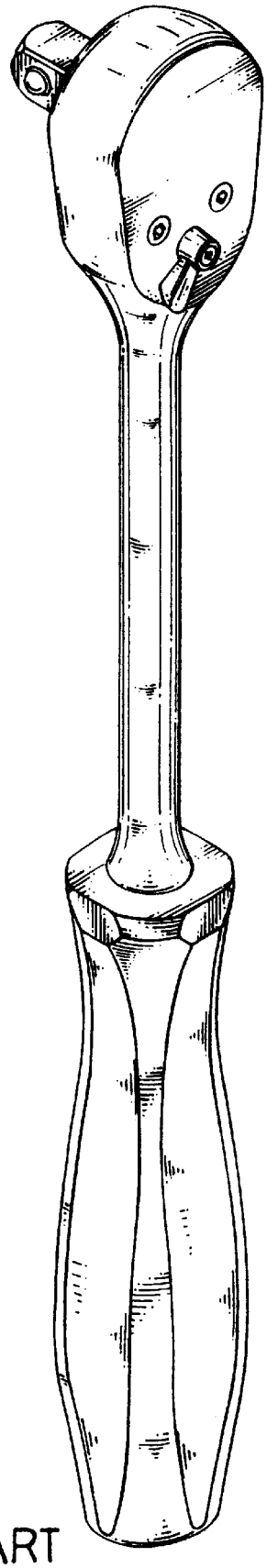
Fig . 1 PRIOR ART
FIG. 1 illustrates a double-reversible ratchet wrench according to the prior art.
Figure 2:
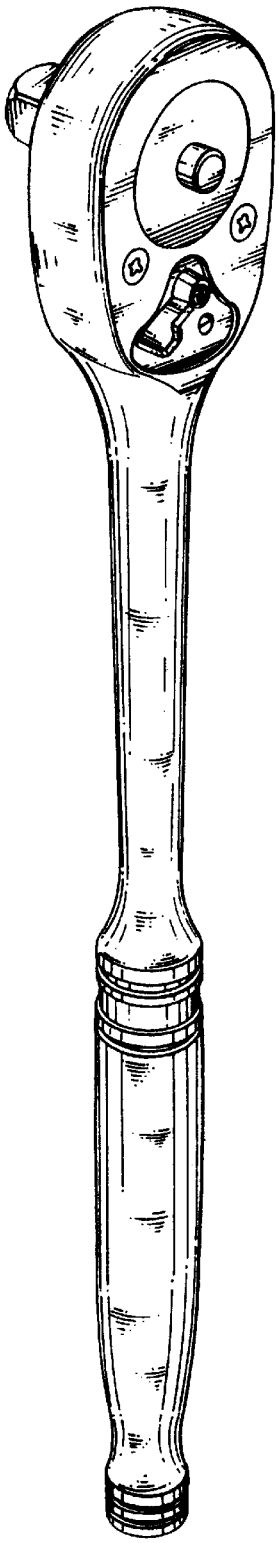
Fig. 2 PRIOR ART
FIG. 2 illustrates another structure of double-reversible ratchet wrench according to the prior art.
Figure 4:
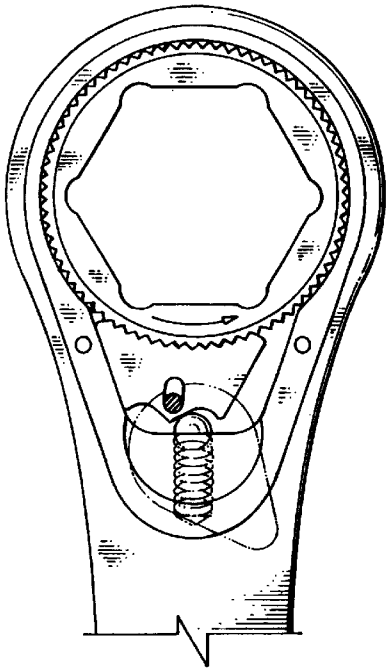
Fig. 4 PRIOR ART
FIG. 4 is a sectional view of still another structure of double-reversible ratchet wrench according to the prior art.
Figure 3:
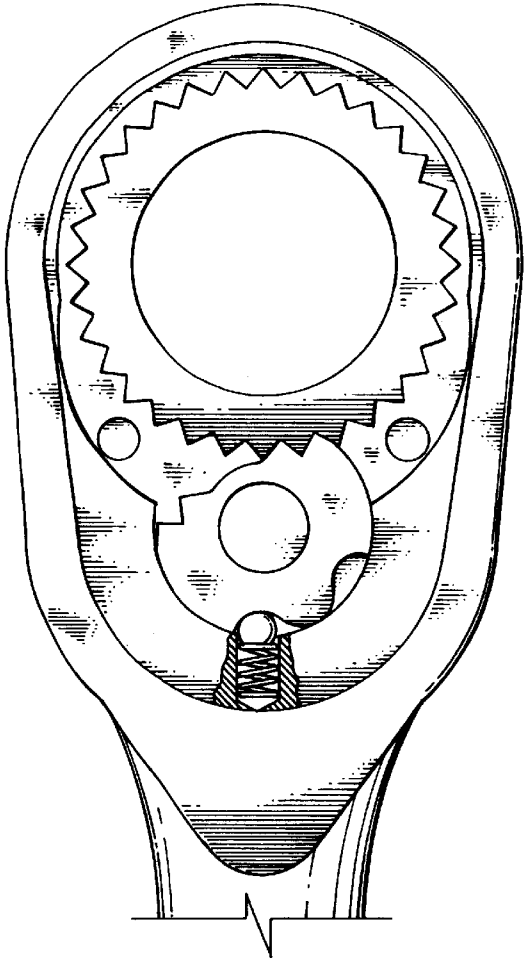
Fig. 3 PRIOR ART
FIG. 3 is sectional view of still another structure of double-reversible ratchet wrench according to the prior art.
Figure 6:
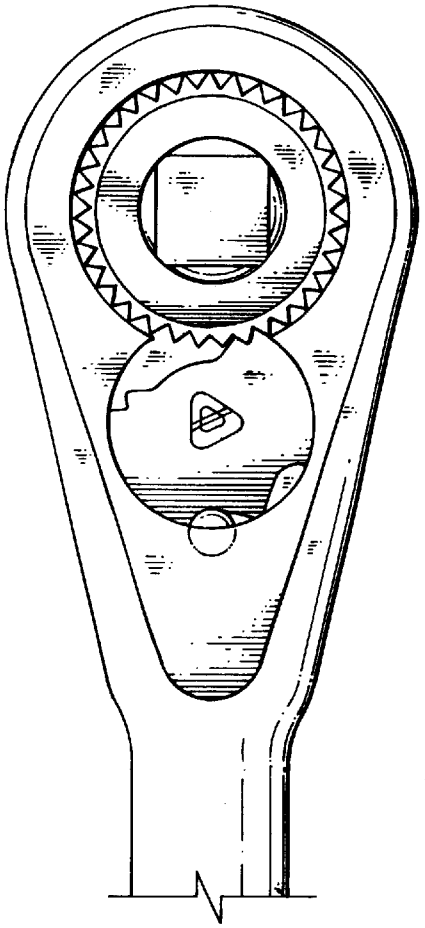
Fig. 6 PRIOR ART
FIG. 6 is a sectional view of still another structure of double-reversible ratchet wrench according to the prior art.
Figure 5:
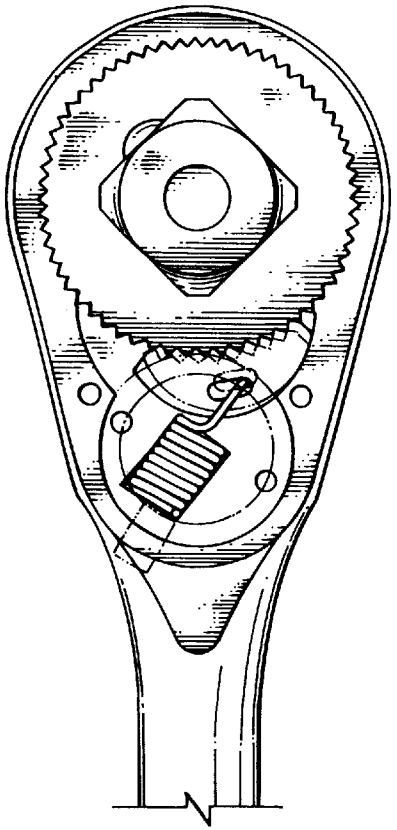
Fig. 5 PRIOR ART
FIG. 5 is a sectional view of still another structure of double-reversible ratchet wrench according to the prior art.
Figure 7:
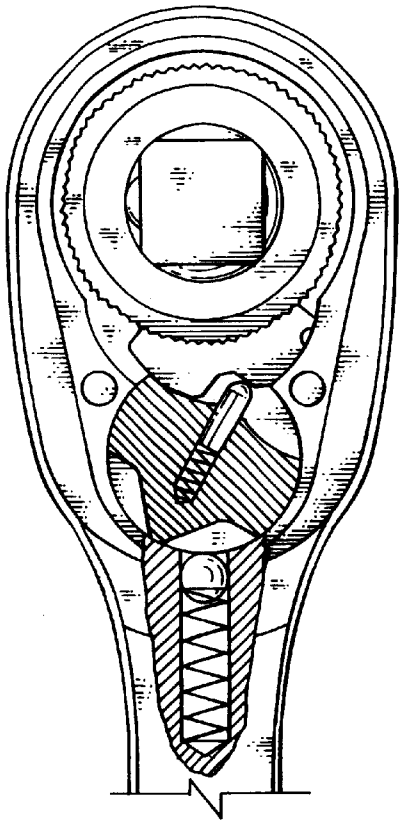
Fig. 7 PRIOR ART
FIG. 7 is a sectional view of a yet further structure of double-reversible ratchet wrench according to the prior art.

Referring to Figures from 8 through 15, a double-reversible ratchet wrench in accordance with the present invention is generally comprised of a wrench body 21, a ratchet wheel 22, a stop member 23, a locating pin 24, a spring 25, a top cap 26, and a C-shaped retainer 27.

Figure 8:
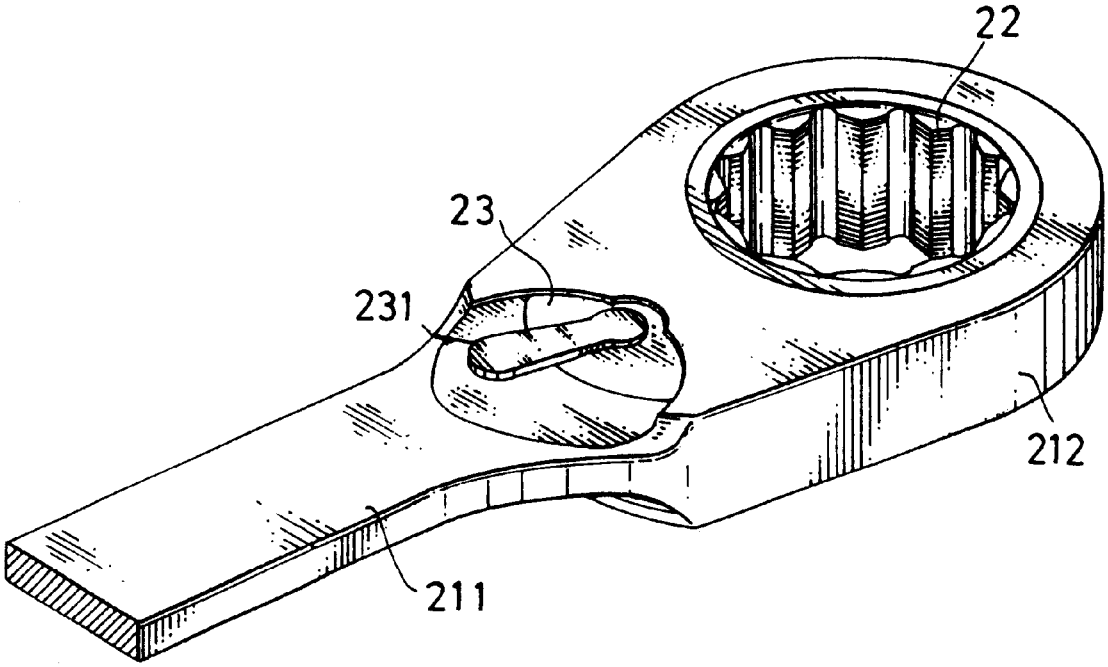
FIG. 8 is a cutaway of a double-reversible ratchet wrench according to one embodiment of the present invention.
Figure 9:
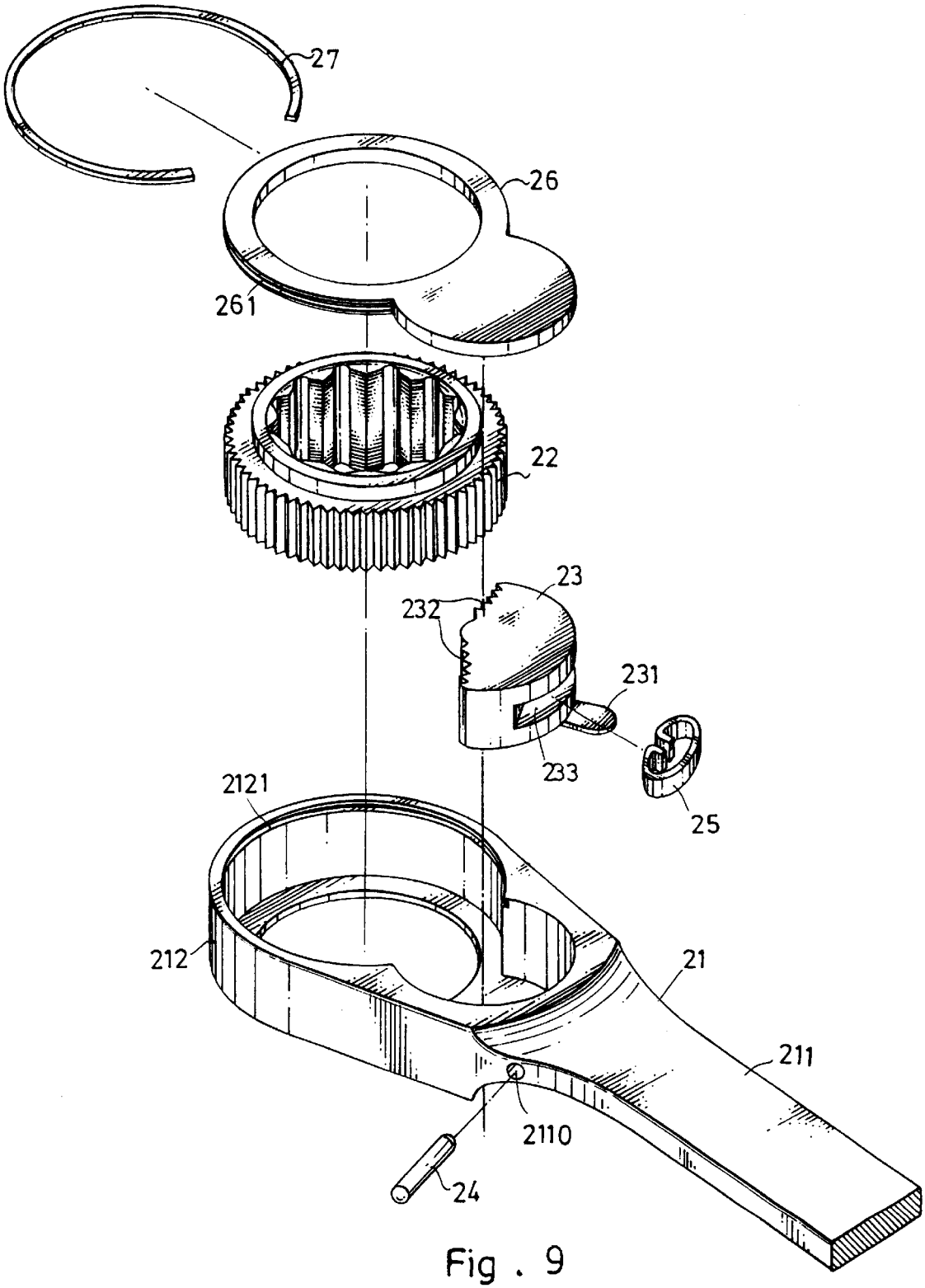
FIG. 9 is an exploded view of the double-reversible ratchet wrench shown in FIG. 8.
Figure 14:
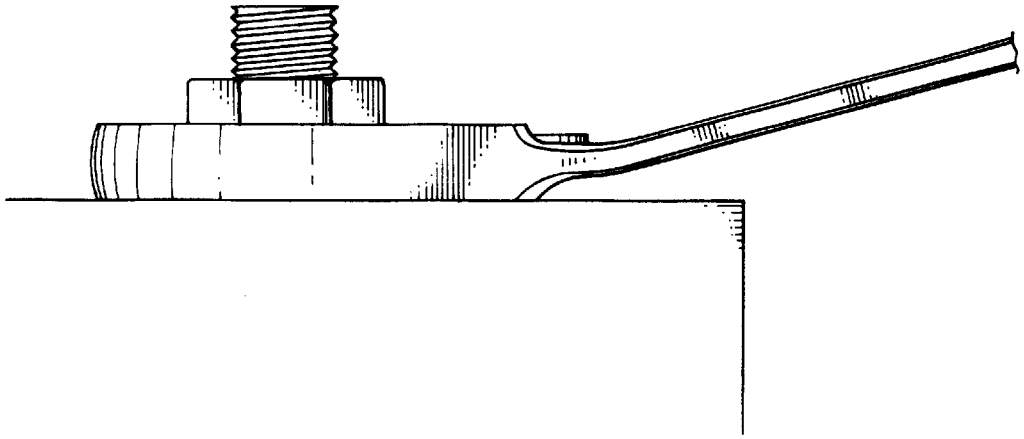
FIG. 14 shows an application example of the present invention.
Figure 15:
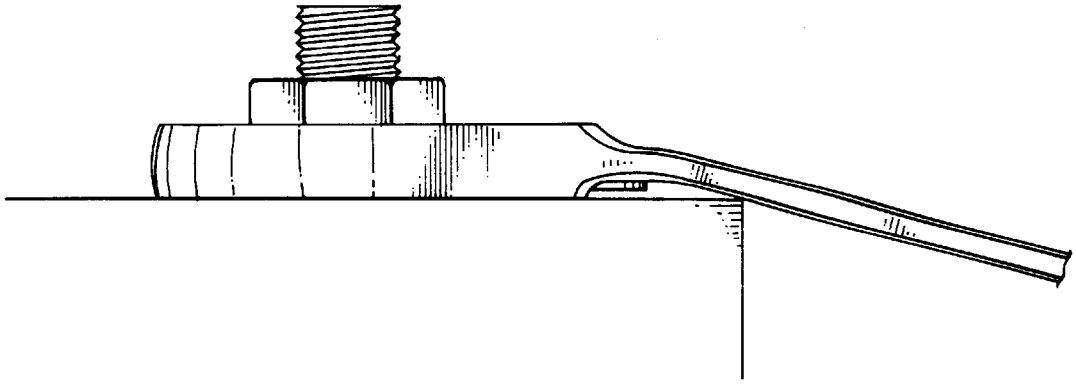
FIG. 15 shows another application example of the present invention.

The wrench body 21 comprises a handle 211, and a box end 212 integral with one end of the handle 211. The handle 211 is a flat, straight bar perpendicularly extended from the periphery of the box end 212 (see FIGS. 8 and 9). In one alternate form of the present invention, the handle 211 extends from the periphery of the box end 212, and slopes backwardly upwards at 15° (see FIG. 14), or backwardly downwards at 15°. The box defined within the box end 212 is formed of two linked round holes of different diameters adapted for receiving the ratchet wheel 22 and the stop member 23. The top cap 26 is covered on the box in the box end 212 to hold the ratchet wheel 22 and the stop member 23 in place. The box end 212 further comprises a locating groove 2121 around the being round hole of the box thereof. The C-shaped retainer 27 is fastened to a peripheral positioning groove 261 of the top cap 26 and peripherally engaged into the locating groove 2121 of the box end 212 to hold the top cap 26 in place.

The stop member 23 is mounted in the small round hole of the box within the box end 212 comprising a smoothly arched, outwardly curved, toothed engagement face 232 forced into engagement with the ratchet wheel 22 to limit the direction of rotation of the ratchet wheel 22 in the box inside the box end 212 a backward finger strip 231 extended out of the box end 212 and adapted for operation by hand to turn the stop member 25 in the box end 212 and to shift the engagement between one of the two halves of the engagement face 232 with the ratchet wheel 22 in controlling the steering direction of the ratchet wheel 22 and a back groove 233, which receives the spring 25. The spring 25 is shaped like an open loop of oval profile, and partially engaged into the back groove 233 of the stop member 23. The locating pin 24 is press-fitted into a side hole 2110 on the handle 211 adjacent to the box end 212 to hold down the spring 25.

Figure 12:
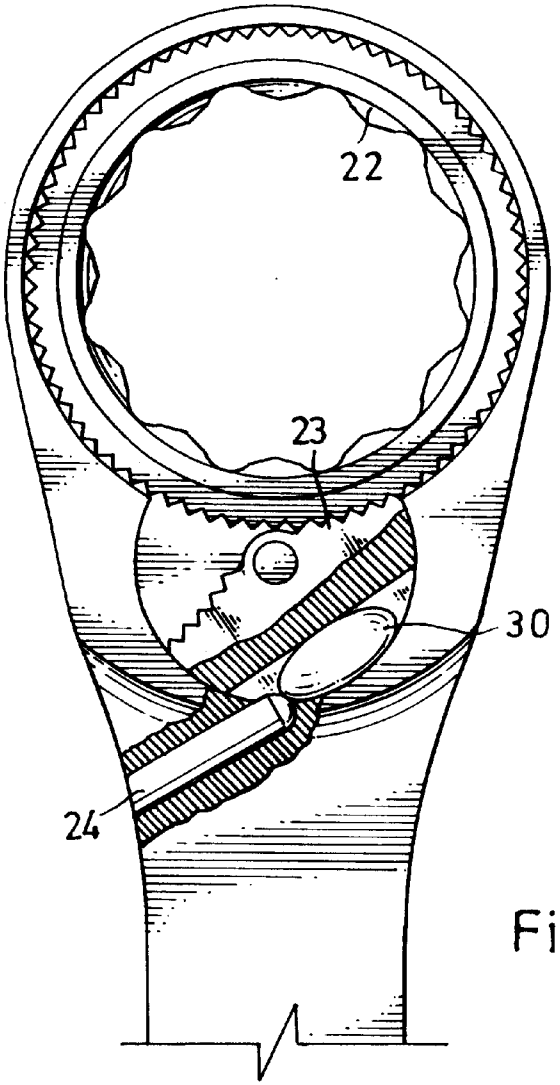
FIG. 12 is a top view in section of another alternate form of the double-reversible ratchet wrench according to the present invention.

Referring to FIG. 12, an elastomer 30 is used to substitute for the aforesaid spring 25, and forced by the locating pin 24 against the stop member 23.

Figure 11:
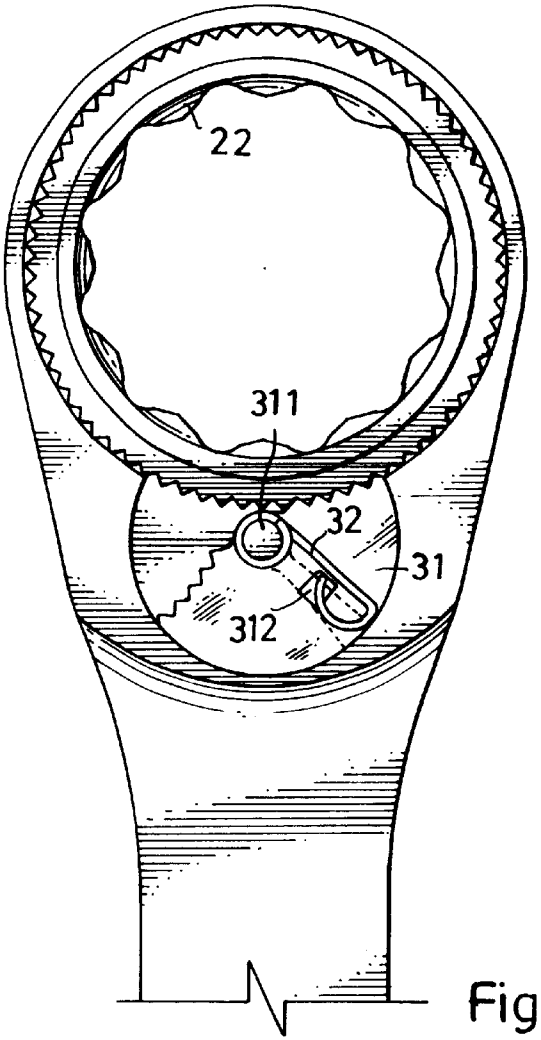
FIG. 11 is a top view in section of an alternate form of the double-reversible ratchet wrench according to the present invention.
Figure 10:
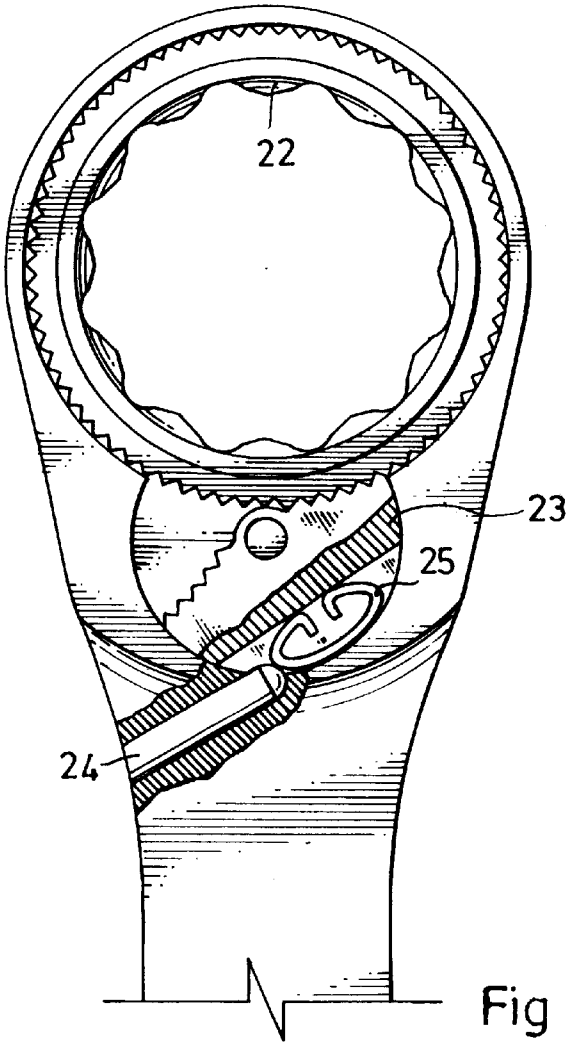
FIG. 10 is a top view in section of the double-reversible ratchet wrench shown in FIG. 8.
Figure 13:
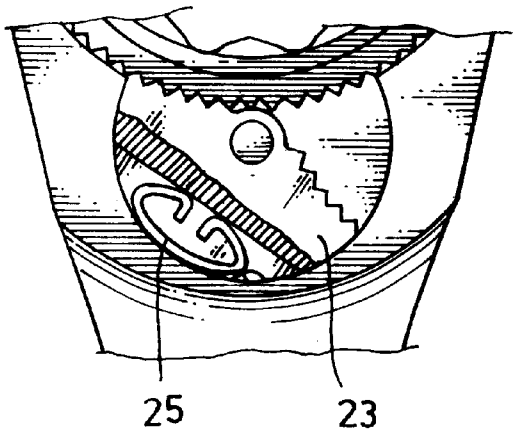
FIG. 13 illustrates the stop member of double-reversible ratchet wrench of FIG. 10 shifted to the other position.

According to the alternate form shown in FIG. 11, the stop member 31 comprises a rod 311 and a guide hole 312, and a spring wire 32 is provided having one end fastened tot he rod 311 and an opposite end curved and hooked in the guide hole 312. The spring wire 32 is forced to produce a sound when the stop member 31 shifted from one position to the other.

According to the alternate form shown in Figures from 17 through 19, the stop member 25 has a wave-like back groove 313, and a steel ball 5 is inserted into the wave-like groove 313 of the stop member 23 and supported on the compression spring 4.

Figure 20:
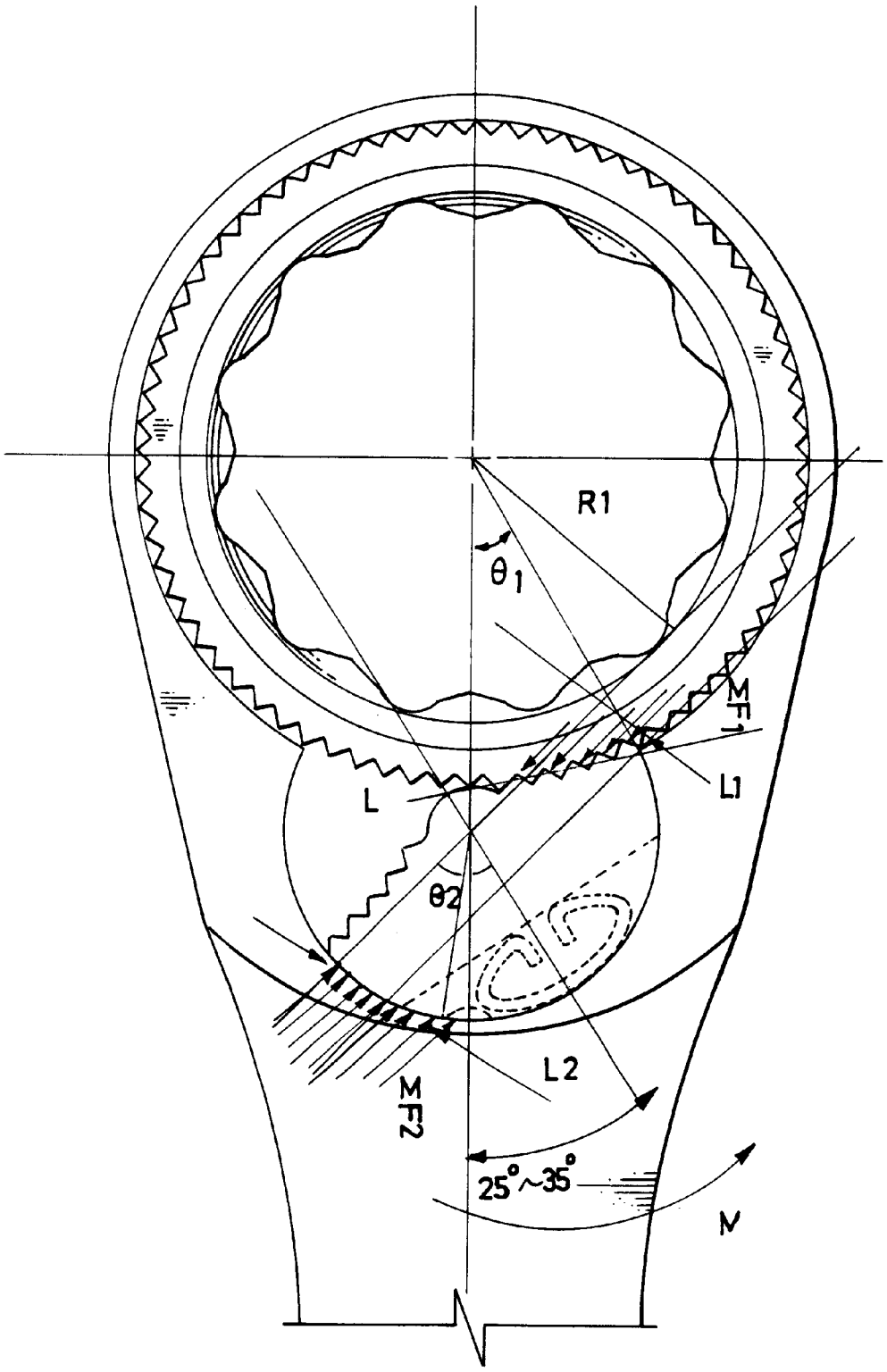
FIG. 20 is a schematic drawing explaining pressure bearing of the present invention.

Force receiving analysis of the present invention is outlined hereinafter with reference to FIG. 20.

$$M1=r1\times F1$$

$$M2=r2\times F2$$

The force is balanced when M1=M2. It is workable to receive the action of external force when M1=M2>M. According to mechanics, the arm of force M2 is short, the unit bearing pressure is high, and the force-bearing area must be increased to distribute the force. The smoothly arched, outwardly curved design of the toothed engagement face 232 greatly increases the engagement area between the ratchet wheel 22 and the stop member 23, and effectively distributes the force of the tangential moment M1 produced by F1. Because all pressure is acted upon the tangent line the moment of the ratchet 22 is greater than the stop member 23, and the unit bearing pressure is relatively small. Therefore, the invention is suitable for making a relatively thinner, shorter, high-performance wrench.

According to tests, when θ2=25°~35°, this structure achieves better engagement angle and matched torsional force, because:

$$\theta 2>\geqq\theta 1$$

$$l3=r1\times\theta 1\quad \theta 1=l3/r1\quad r1 \text{ is a constant, } \theta 1\ l3$$

$$l2=r21\times\theta 2\quad \theta 2=l2/r2\quad r2 \text{ is a constant, } \theta 2\ l2$$

thus,

When r2 is increased, θ1 is increased, and l3 is relatively increased, and therefore the following data is obtained (n is the designed parameter).

| θ 2 | r2 | θ 1 | r1 | n = r1/r2 |
|---|---|---|---|---|
| 25 | 2291.84x l2 | 16.13 | 3552.35x l1 | 1.58 |
| 26 | 2203.69x l2 | 16.88 | 3393.68x l1 | 1.54 |
| 27 | 2212.07x l2 | 17.65 | 3246.76x l1 | 1.53 |
| 28 | 2046.28x l2 | 18.67 | 3069.42x l1 | 1.58 |
| 29 | 1975.72x l2 | 18.85 | 3121.63x l1 | 1.55 |
| 30 | 1909.86x l2 | 20.00 | 2864.78x l1 | 1.52 |
| 31 | 1848.25x l2 | 20.39 | 2809.34x l1 | 1.50 |
| 32 | 1790.50x l2 | 21.33 | 2685.75x l1 | 1.52 |
| 33 | 1736.24x l2 | 21.57 | 2656.44x l1 | 1.51 |
| 34 | 1685.17x l2 | 21.73 | 2612.01x l1 | 1.56 |
| 35 | 1637.02x l2 | 22.34 | 2553.75x l1 | 1.52 |

l = rxβx3.1416/180 = 0.1745rxβ

Analysis on pressure received by the stop member and the flywheel:

Axle Wheel:

$$\Sigma F1=P1/A1=P1/l1\times t$$

$$P1=\Sigma F1\times l1\times t$$

Actually Bearing $$l3=r1\times\theta 1$$

$$P'1=\Sigma F1\times r1\times\theta l\times t$$

Stop Member $$\Sigma F2=P2/A2$$

$$l2=r2\times\theta 2$$

$$P2=\Sigma F2\times r2\times\theta 2\times t$$

Because l2>l1,P1<P'1, actual bearing pressure is greater than the stop member bearing pressure. The best stop member design must keep l2≧l3, that is θ2≧θ1. This design greatly increases the pressure bearing area, and therefore a relatively high torsional force is achieved.

Figure 16:
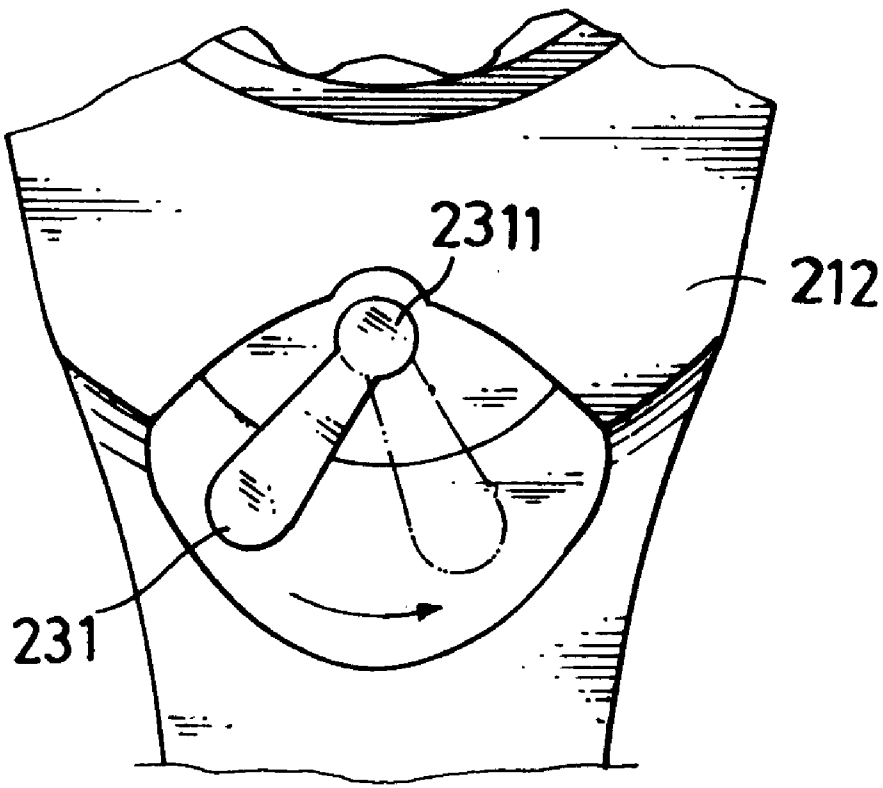
FIG. 16 is a schematic drawing showing the turning direction of the backward finger strip of the stop member in the wrench body according to the present invention.
Figure 17:
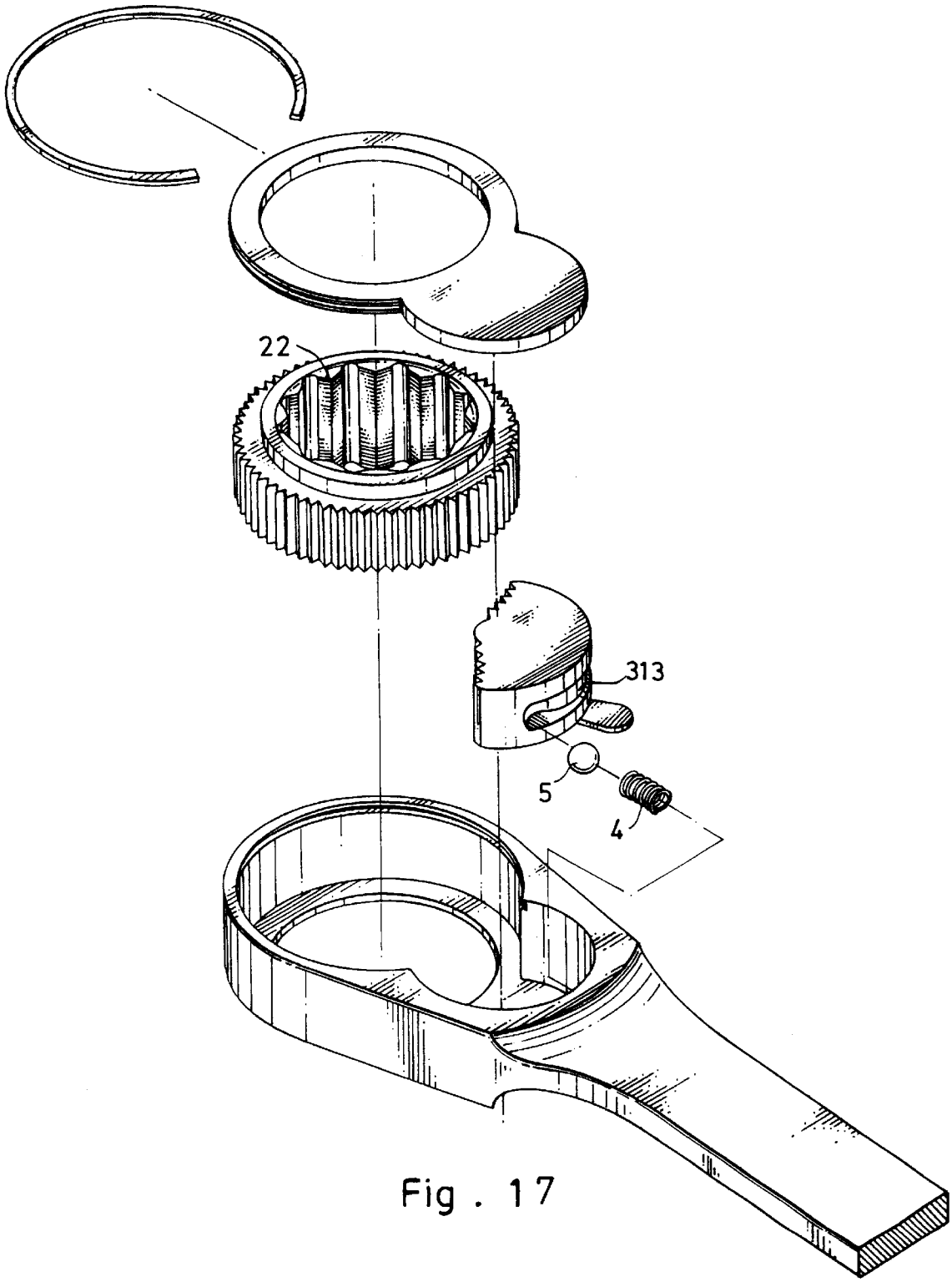
FIG. 17 is an exploded view of still another alternate form of the double-reversible ratchet wrench according to the present invention.
Figure 19:
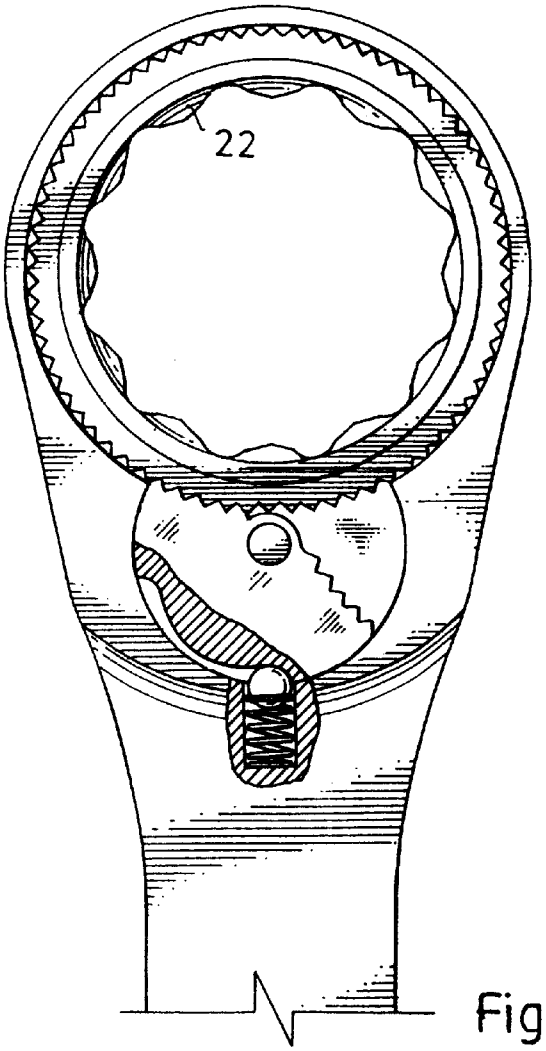
FIG. 19 is similar to FIG. 18 but showing the stop member shifted to the other position.
Figure 18:
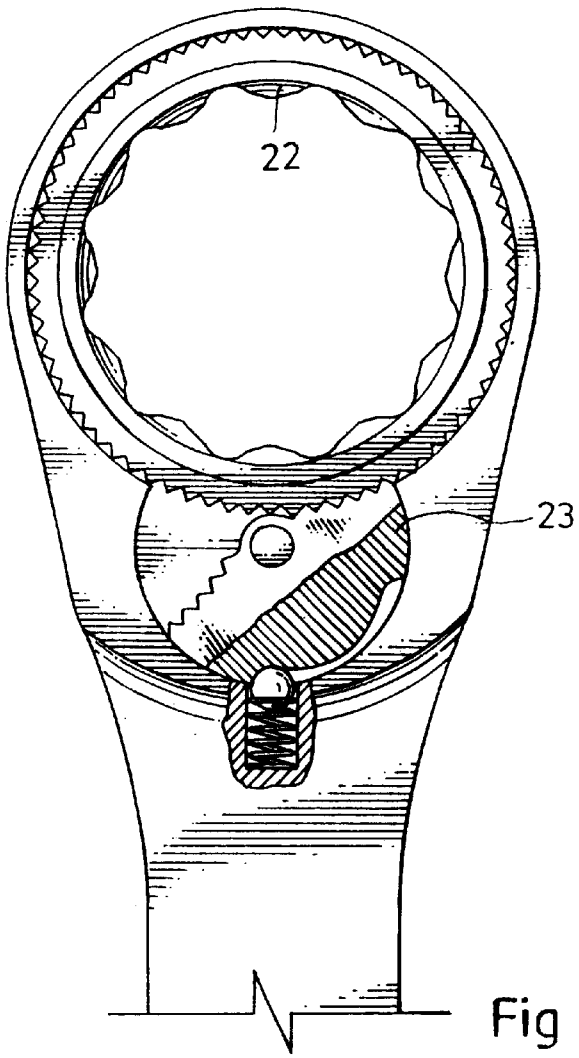
FIG. 18 is an assembly view in section of the double-reversible ratchet wrench shown in FIG. 17.

In FIG. 16, the backward finger strip 231 is disposed below the elevation of the box end 212 and fixedly connected to the stop member 23. The connection point 2311 between the backward finger strip 231 and the stop member 25 is equally spaced from two distal ends of the smoothly arched, outwardly curved, toothed engagement face 232, so that the backward finger strip 231 can be turned with less effort to shift the engagement between the ratchet wheel 22 and the stop member 23.

Figure 21:
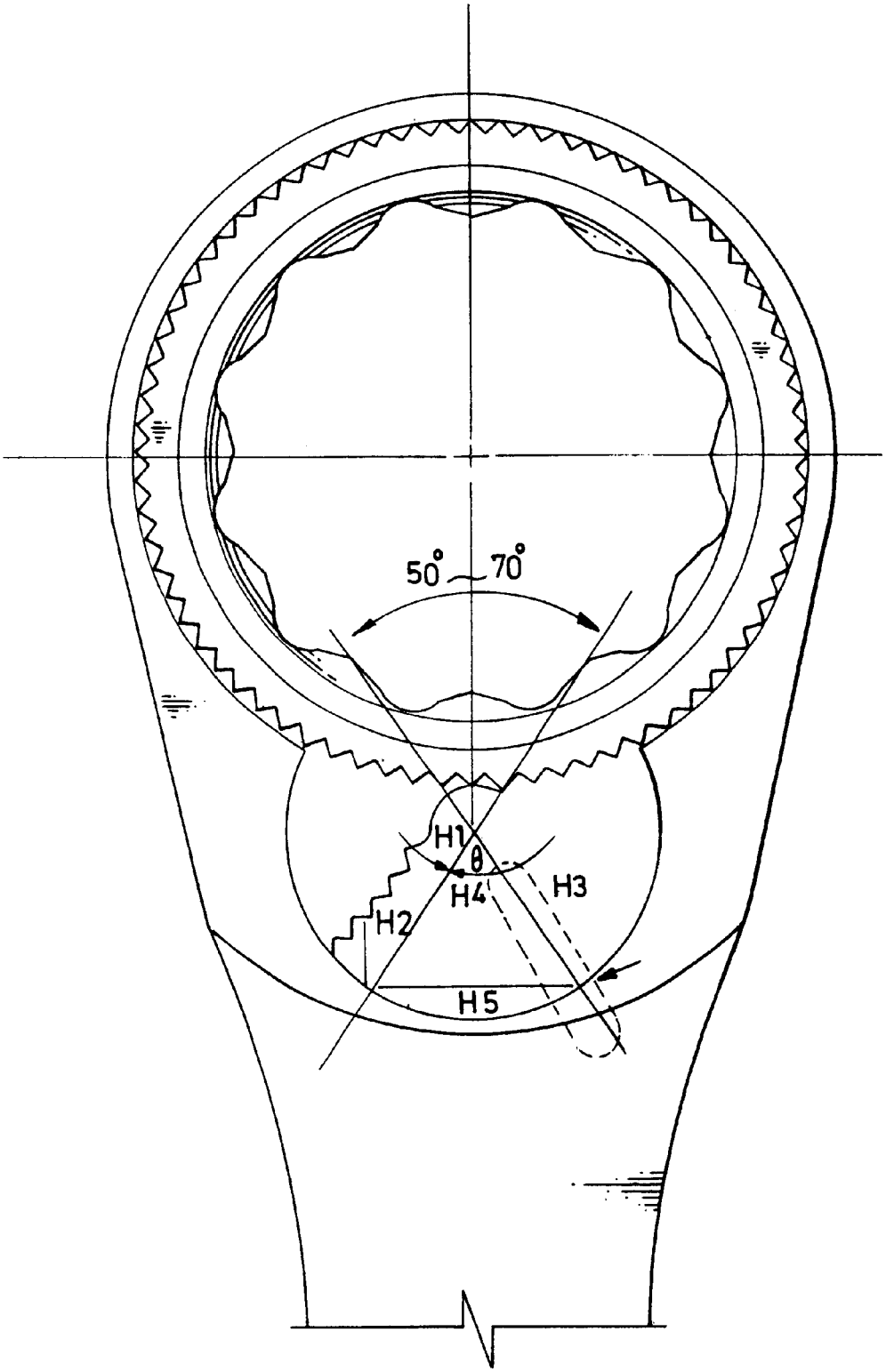
FIG. 21 is a schematic drawing explaining the mathematical analysis of the determination of the position of the backward finger strip at the stop member according to the present invention.

The position of the backward finger strip 231 at the stop member 23 is determined subject to the mathematical analysis outlined hereinafter with reference to FIG. 21.

$$H1/H3=H4/H5$$

$$H4=H1\times\theta 3$$

$$H5=H3\times\theta 3$$

H1 1/H5 in indirect proportion

The greater H1 is, the smaller H5 will be, that is, the turning angle of the backward finger strip is relatively smaller if H1 (the distance between the backward finger strip and the center point of the stop member ) is relatively greater. The design of the backward finger strip is based on this concept.

According to tests, it shows that:

When θ3=50°~70°, H'2 chord length is relatively greater subject to the increasing of the angle. The smaller H'2 is, the smaller R and the stronger the structural strength will be. If wishing to reduce H'2, the elevation of the backward finger strip must be lowered subject to the aforesaid equation. Preferred data is shown below:

| θ 3 | H5 | H'2 | H'5 θ |
|---|---|---|---|
| 50 | 0.873 | 0.0937 | 0.845 |
| 51 | 0.890 | 0.0974 | 0.861 |
| 52 | 0.908 | 0.1012 | 0.877 |
| 53 | 0.925 | 0.1051 | 0.892 |
| 54 | 0.942 | 0.1090 | 0.908 |
| 55 | 0.960 | 0.1130 | 0.923 |
| 56 | 0.977 | 0.1171 | 0.939 |
| 57 | 0.995 | 0.1212 | 0.954 |
| 58 | 1.012 | 0.1254 | 0.970 |
| 59 | 1.030 | 0.1296 | 0.985 |
| 60 | 1.047 | 0.1340 | 1.000 |
| 61 | 1.065 | 0.1384 | 1.015 |
| 62 | 1.082 | 0.1428 | 1.030 |
| 63 | 1.100 | 0.1474 | 1.045 |
| 64 | 1.117 | 0.1520 | 1.060 |
| 65 | 1.134 | 0.1566 | 1.075 |
| 66 | 1.152 | 0.1613 | 1.089 |
| 67 | 1.169 | 0.1661 | 1.104 |
| 68 | 1.187 | 0.1710 | 1.118 |
| 69 | 1.204 | 0.1759 | 1.133 |
| 70 | 1.222 | 0.1808 | 1.147 |

What is claimed is:

1. double-reversible ratchet wrench of the type comprising:

a wrench body, said wrench body comprising a handle and a box end integral with one end of said handle, said box end defining a box formed of a big round hole and a small round hole linked to the big round hole;

a ratchet wheel mounted in the big round hole inside said box end of said wrench body and adapted for turning a bolt or nut with said wrench body;

a stop member mounted in the small round hole in said box end of said wrench body and turned to control the direction of rotation of said ratchet wheel in said wrench body;

a cap covered on the box of said box end to hold said ratchet wheel and said stop member in place;

a C-shaped retainer fastened to the box of said box end to secure said cap in position; and supporting means installed in said wrench body to support positioning of said stop member in said box end;

wherein:

said stop member comprises a smoothly arched, outwardly curved, toothed engagement face forced into engagement with said ratchet wheel to limit the direction of rotation of said ratchet wheel in said box end, a backward finger strip extended out of said box end and adapted for operation by hand to turn said stop member in said box end and to shift the engagement between one of two halves of said engagement face with said ratchet wheel in controlling the steering direction of said ratchet wheel, and a back groove;

said supporting means comprises a spring shaped like an open loop of oval profile, and partially engaged into the back groove of said stop member, a locating pin installed in a side hole on the handle of said wrench body to hold down said spring against said stop member.

* * * * *